US007383836B2

(12) United States Patent
Klemming

(10) Patent No.: US 7,383,836 B2
(45) Date of Patent: Jun. 10, 2008

(54) FIREPIT WITH PIVOTING SLIDING DOOR

(76) Inventor: Ulf J. P. Klemming, 215 Chao Hui Road, Zhong Shan Hua Yuan, Qiu Yue Yuan 17A, Hangzhou (CN) 310014

( * ) Notice: Subject to any disclaimer, the term of this patent is extended or adjusted under 35 U.S.C. 154(b) by 0 days.

(21) Appl. No.: 10/897,444

(22) Filed: Jul. 24, 2004

(65) Prior Publication Data

US 2004/0255930 A1 Dec. 23, 2004

Related U.S. Application Data

(63) Continuation-in-part of application No. 10/282,793, filed on Oct. 28, 2002, now Pat. No. 6,851,423.

(51) Int. Cl.
*F24B 1/182* (2006.01)

(52) U.S. Cl. ..... 126/506; 126/519; 126/548; 126/551; 126/190

(58) Field of Classification Search ..... 126/506, 126/519, 544, 547, 548, 550, 551, 554, 190, 126/201, 85 R, 92 B; D23/348
See application file for complete search history.

(56) References Cited

U.S. PATENT DOCUMENTS

| | | | | |
|---|---|---|---|---|
| 4,216,760 | A * | 8/1980 | Wiggins | 126/508 |
| 5,836,298 | A * | 11/1998 | Grady | 126/506 |
| 5,960,788 | A * | 10/1999 | Bach et al. | 126/506 |
| D457,229 | S * | 5/2002 | Chen | D23/343 |
| 6,851,423 | B2 * | 2/2005 | Klemming | 126/506 |

* cited by examiner

*Primary Examiner*—Jiping Lu
(74) *Attorney, Agent, or Firm*—Don J. Carnegie

(57) ABSTRACT

The invention includes a fire pit having a domed firescreen fixed atop a firebox bowl fixed atop a support frame. One specific version of the invention includes a domed firescreen having an essentially triangular doming door panel that pivots at its apex while its bottom edge slides along a sliderail.

17 Claims, 12 Drawing Sheets

FIREPIT WITH PIVOTING SLIDING DOOR

CROSS REFERENCE TO RELATED APPLICATIONS

This application is a continuation-in-part, and claims the benefit of, U.S. Utility patent application Ser. No. 10/282,793 filed 28 Oct., 2002 now U.S. Pat. No. 6,851,423.

FEDERALLY SPONSORED RESEARCH AND DEVELOPMENT

Not applicable.

MICROFICHE APPENDIX

Not applicable.

BACKGROUND OF THE INVENTION (1) Field of the Invention

The present invention generally relates to the field of fire pits and freestanding fireplaces. More particularly, this invention, in its most general form includes a fire pit comprising a domed firescreen atop a firebox bowl atop a support frame. One version of the invention includes a domed firescreen having an essentially triangular doming door panel that pivots at its apex while its bottom edge slides along a sliderail.

(2) Description of Related Art Including Information Disclosed 37 CFR 1.97 and 1.98.

Known in the art are various fireplaces or freestanding firepits; various small outdoor fireplaces or freestanding firepits have been proposed or are in actual use. For example, the following patents are arguably related to the patentability of the subject invention:

Sorensen U.S. Design Pat. No. 318,327 shows the ornamental features of a fireplace which is closed at the top and apparently has grating which can be slidably opened at its side. However, there is no indication how the grating is supported or carried, and whether the slidable grating is a rigid or a flexible, drape-like material.

Yager U.S. Pat. No. 3,220,400 describes a stove construction having a pair of separable flexible fireplace drawscreens.

Grady U.S. Pat. No. 5,598,834 pertains to a portable outdoor fireplace closed at the top having multiple rigid vertical side screen panels. One of the panels is removable and insertable.

Grady U.S. Pat. No. 5,836,298 relates to a portable outdoor fireplace closed at the top having one or two vertically supported hinged side screen panels.

Hannebaum U.S. Pat. No. 3,499,432 describes a heating unit having a chimney at the top with a plurality of enclosing glass side panels surrounding the firebox.

Miller U.S. Pat. No. 3,777,735 discloses a fireplace having an exhaust pipe at the top and circular side curtains hung from rails.

Wiggins U.S. Pat. No. 4,316,760 describes a fireplace open at the top with frustoconical sheet metal sides having an opening therein for a firescreen which is movable in a channel.

Bach et al U.S. Pat. No. 5,960,788 and Bach et al U.S. Design Pat. No. 420,115 relate to a collapsible outdoor fireplace having a hinged door.

BRIEF SUMMARY OF THE INVENTION

Briefly, one general version of the present invention comprises an outdoor fireplace having a supporting base, a vertical pedestal projecting upwardly from said base, a firebox in the shape of a hollow bowl open at its top and supported by said pedestal, a vertical hollow cylindrical wall carried at its bottom end by the periphery of said hollow bowl and comprising a series of contiguous fixed rigid, open screen, arcuate panels and one rigid open screen arcuate panel slidably received between two of said fixed panels and carried at its upper end by a horizontal track which spans two of said fixed panels, said fixed panels being affixed at their upper ends to the lower peripheral edge of the larger end of an inverted dish-like member, said inverted dish-like member having a central opening therein providing a vent, and means forming part of the periphery of said hollow bowl for engaging said slidable rigid open screen arcuate panel at its lower end.

The slidable open screen panel is provided at its upper extremity with horizontally spaced apart hooks which slidably ride on the horizontal track. This track and associated hooks make opening and closing of the fireplace simple, safe and smooth. There is no risk of any part of the slidable panel coming into contact with the contents of the fireplace. The lower means for engaging the slidable open screen panel may be either an upstanding member integrally formed with the periphery of the hollow bowl in which case the slidable open screen panel has horizontally spaced apart hooks to slidably engage the upstanding member. Alternatively, the lower means for engaging the slidable open screen panel may be a groove integrally formed in the periphery of the hollow bowl in which case the lower edge of the slidable open screen panel rides in the groove.

The use of the upstanding member or the groove to engage the lower extremity of the slidable open screen panel provides distinct advantages over the use of a lower bridging track member which is supported only at its ends and can distort due to its proximity to the heat generated in the hollow bowl, resulting in jamming or difficulty in sliding the open screen panel.

In most general terms, the invention disclosed herein comprises (includes) a fire pit having a domed firescreen fixed atop a firebox bowl fixed atop a support frame. One specific version of the invention includes a domed firescreen having an essentially triangular doming door panel that pivots at its apex while its bottom edge slides along a sliderail.

One primary object of the present invention is to provide a fire pit that allows physical access to the interior as desired, yet separates the interior fire and ash and flammable materials from the exterior to the extent desired.

Another primary object of the present invention is to provide a fire pit having an access door that can be actuated with minimal exposure to heat.

Another primary object of the present invention is to provide a fire pit having an access door that remains substantial in place at one point, yet moves sufficient to provide ingress and egress to the fire pit.

Another primary object of the present invention is to provide a fire pit having an access door that pivots at the top, while facilitating sliding of the bottom.

Another object of the invention is to provide a fire pit allowing substantial visual access to the interior fire, yet maintaining physical separation of the interior ash and flammable materials.

Other objects will be apparent from a reading of the written description disclosed herein, together with the claims.

These drawings illustrate certain details of certain embodiments. However, the invention disclosed herein is not limited to only the embodiments so illustrated. The invention disclosed herein may have equally effective or legally equivalent embodiments.

DETAILED DESCRIPTION OF THE INVENTION

Figure 1:
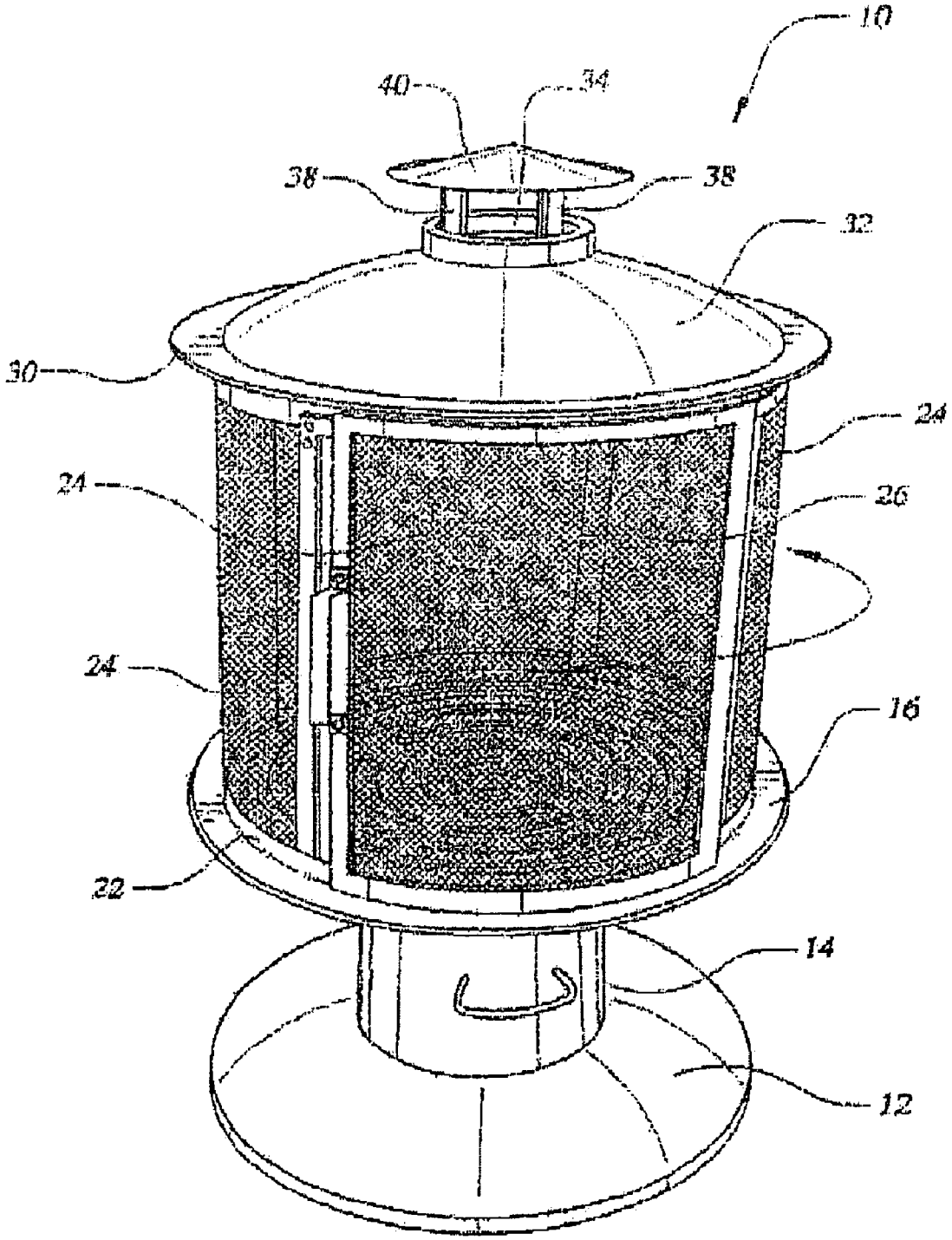
FIG. 1 is a perspective view of the preferred embodiment of the fireplace of this invention.
Figure 2:
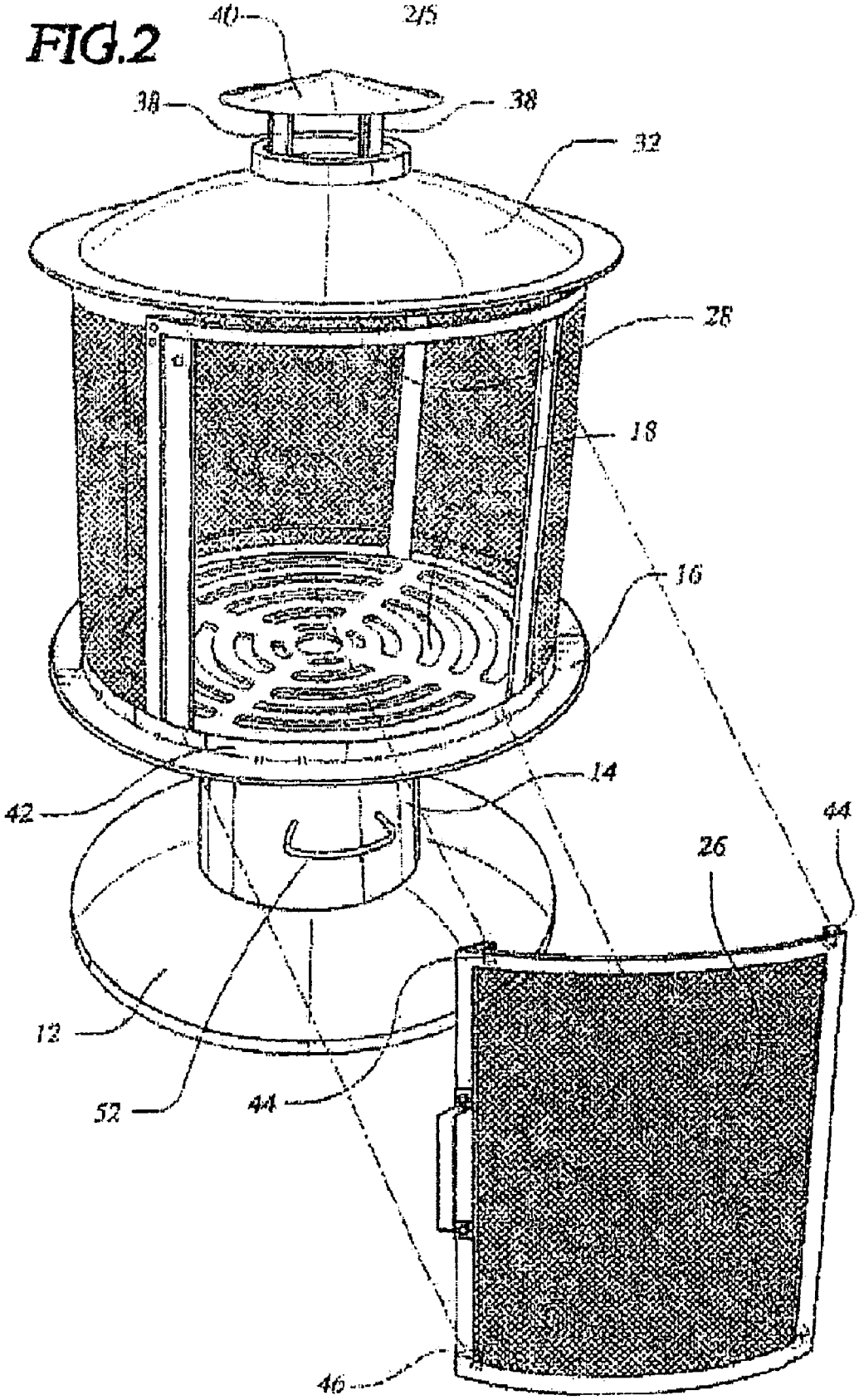
FIG. 2 shows the fireplace of FIG. 1 with the slidable open screen panel removed, exposing the interior of the fireplace and the upper and lower horizontal tracks on which the slidable panel rides.
Figure 3:
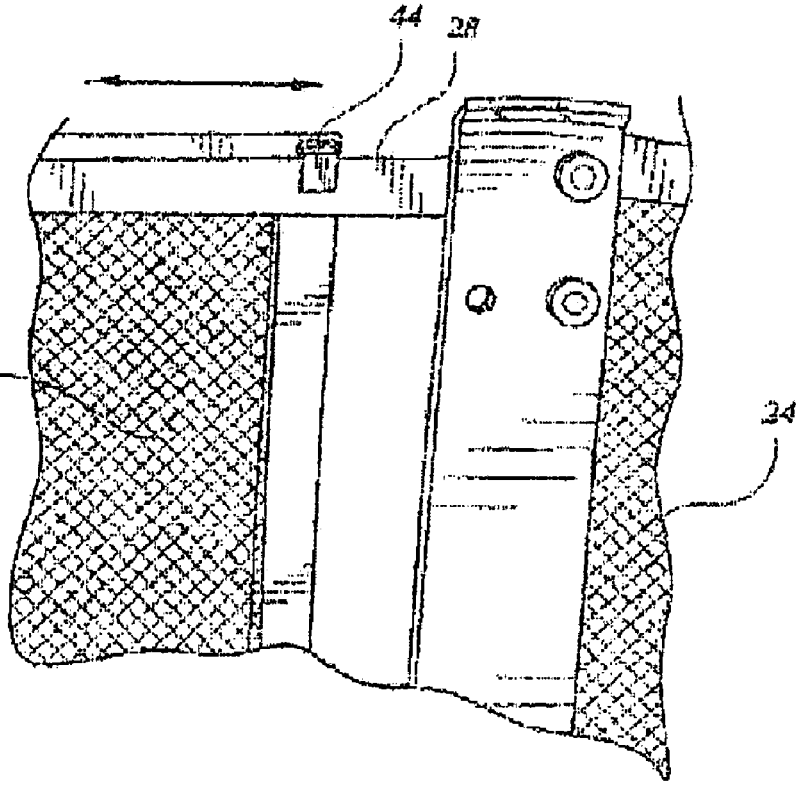
FIG. 3 is a partial enlarged rear view of the upper horizontal track spanning two fixed panels and showing part of the sliding panel with one of the hooks riding in place on the horizontal track.
Figure 4:
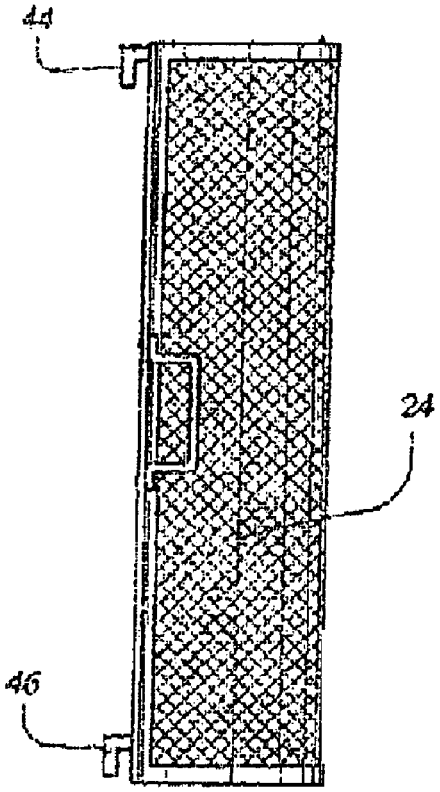
FIG. 4 is a side plan view of the arcuate slidable open screen panel.
Figure 5:
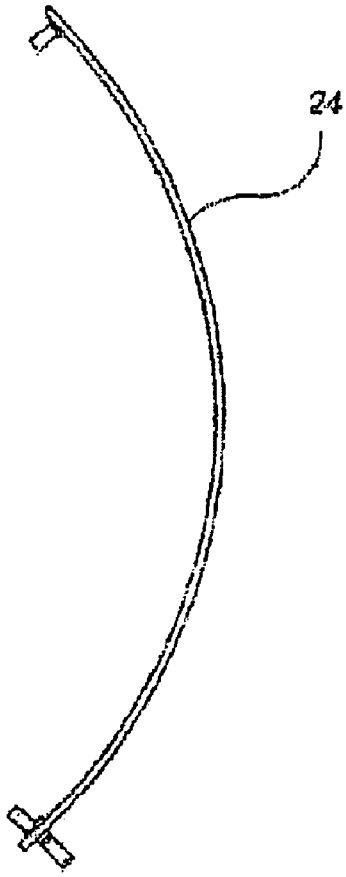
FIG. 5 is a top plan view of the arcuate slidable open screen panel.

Turning to the drawings in more detail, FIG. 1 shows an outdoor fireplace 10 having a supporting base 12, a vertical pedestal 14 projecting upwardly from the base 12, a firebox in the shape of a hollow bowl 16 open at its top 18 and supported by the pedestal 14, a vertical hollow cylindrical wall 20 carried at the bottom end 22 by the periphery of said hollow bowl 16 and comprising a series of fixed rigid, open screen, arcuate panels 24 and one rigid open screen arcuate panel 26 slidably carried at its upper end by a horizontal track 28 which extends between two of the fixed panels at each of its ends.

The fixed panel 24 are affixed at their upper ends to the lower peripheral edge 30 of the larger end of an inverted dish-like member 32, the inverted dish-like member 32 having a central opening 34 therein providing a vent 36, projecting above and at opposed sides of the central opening, a pair of vertical support members 38 and a cover member 40 carried by the vertical support members 38 and overhanging the central opening 34.

Figure 6:
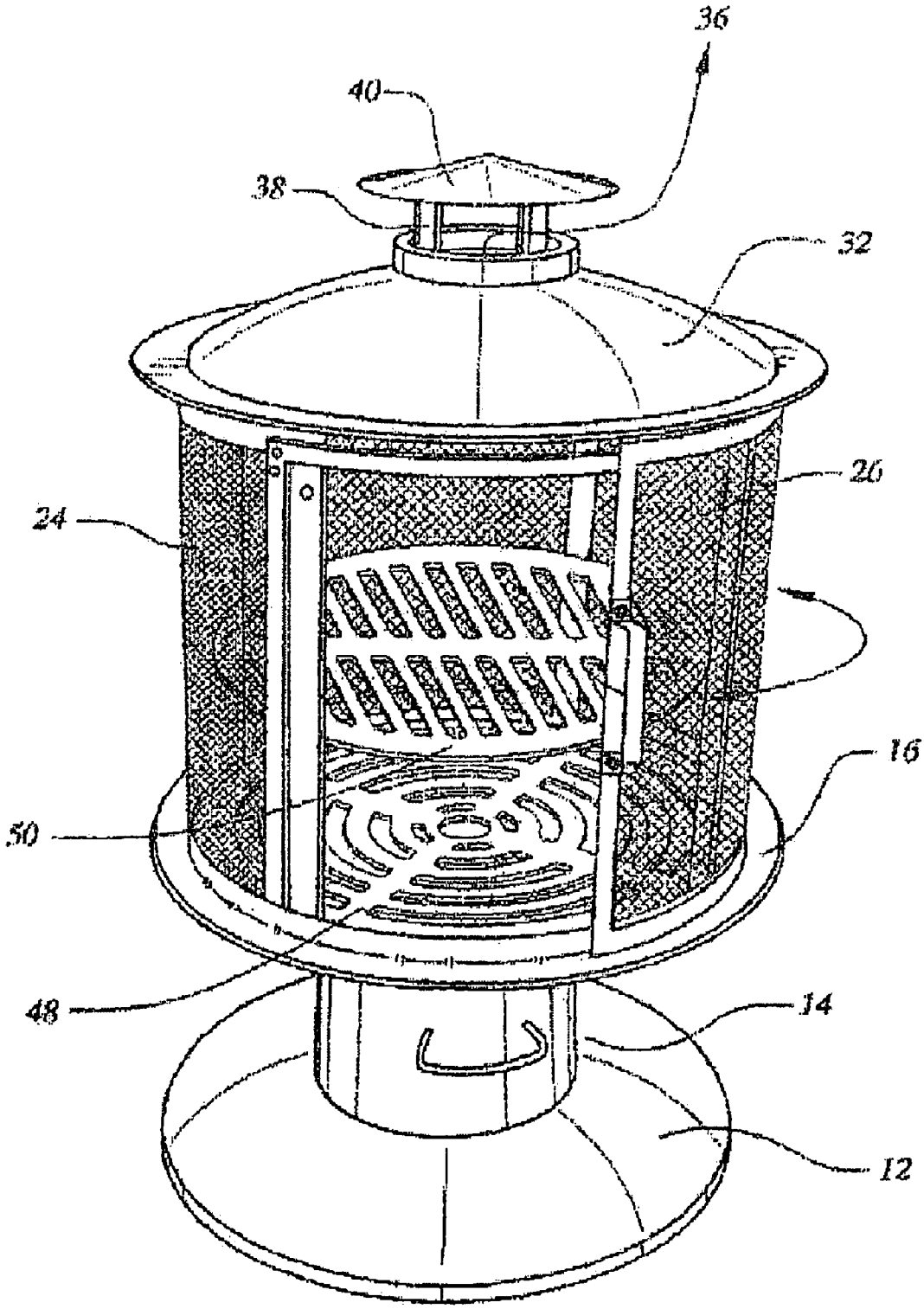
FIG. 6 shows the fireplace of FIGS. 1 to 5 further provided with the optional centrally disposed swingout cooking grill or grate and showing the slidable panel partially slid open.
Figure 7A:
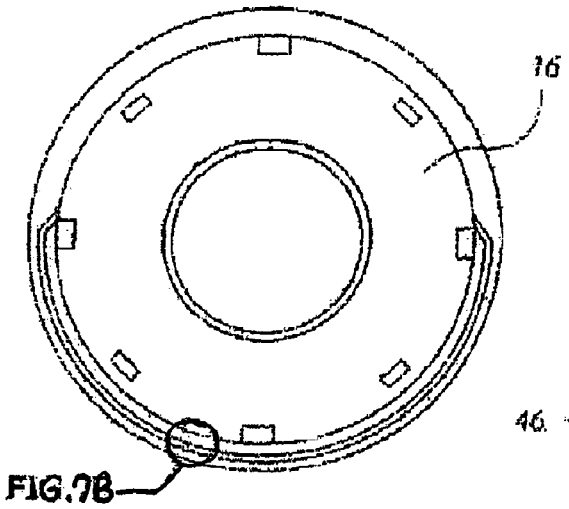
FIG. 7 showing a top view of the hollow bowl with integrally formed upstanding member (FIG. 7A) together with an enlarged partial section (FIG. 7B) showing a hook on the slidable open screen panel engaging the upstanding member.
Figure 7B:
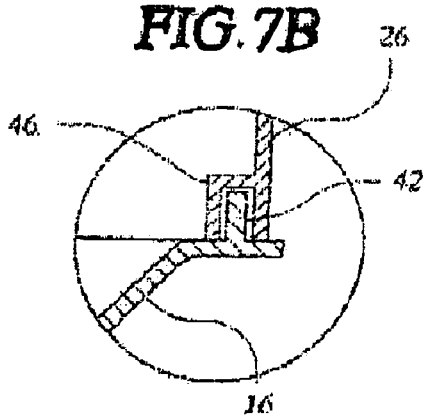

The slidable panel 26 is provided at its upper edge with a pair of spaced-apart hooks 44 which engage track 28. In the embodiment of FIG. 7, another pair of spaced-apart hooks 46 engage the integral upstanding member 42 formed in the periphery of hollow bowl 16. In this way, the slidable panel 26 is securely held at both of its upper and lower extremities and still can easily be slid open and shut, as indicated by the curved arrows shown in FIGS. 1 and 6, to access the interior of the fireplace and to close the fireplace to prevent undesired escape of sparks and ash.

Figure 8A:
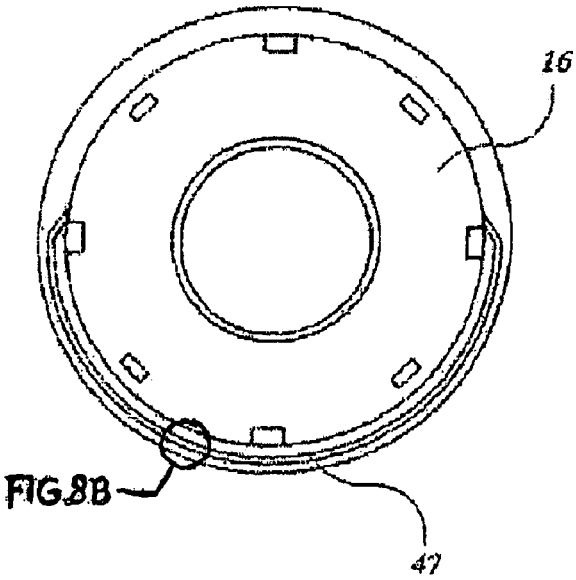
FIG. 8 shows the alternate embodiment to FIGS. 1 to 7 wherein the periphery of the hollow bowl has an integral ledge with a groove formed therein (FIG. 8A) which receives the lower edge of the slidable open screen panel (FIG. 8B).
Figure 8B:
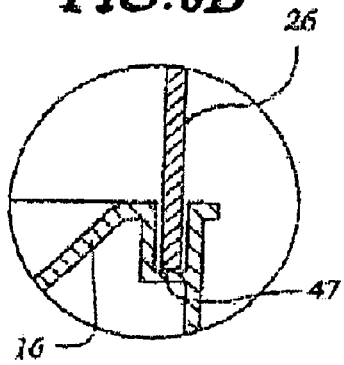
Figures 9, 10:
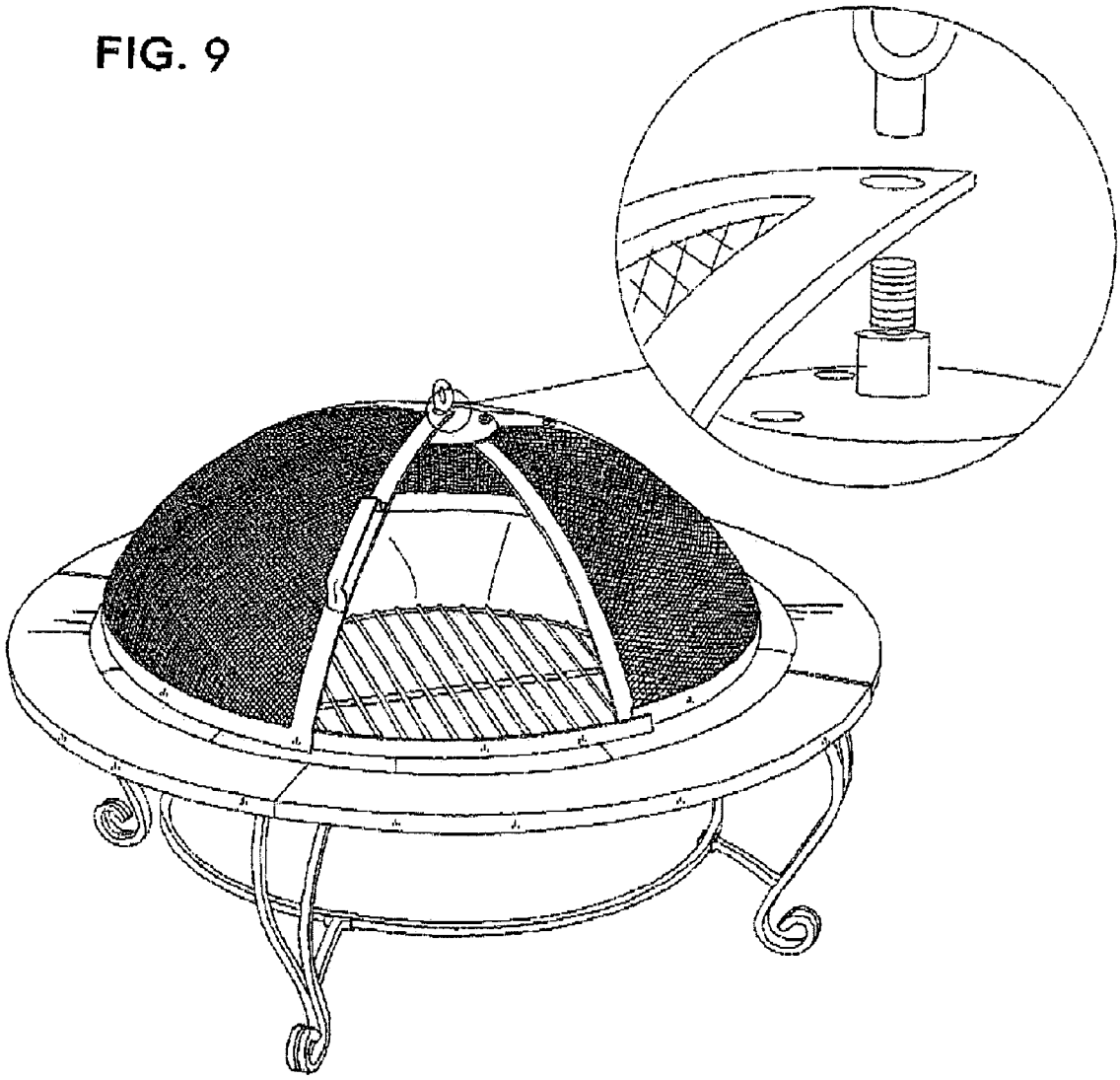
FIG. 9 depicts a front perspective view of one domed version of the invention.
FIG. 10 depicts an exploded magnified partial view of an apical pivot portion of the invention of FIG. 9.

Alternatively, as shown in FIG. 8, the periphery of hollow bowl 16 can have an integrally formed ledge in which groove 47 is formed. The lower edge of slidable panel 26 rides in groove 47.

The central dish like member 32 is closed except for the opening 34 leading to the vent 36.

The cover member 40 provides for dispersal and also permits outdoor use of the fireplace in rainy conditions.

Firegrate 48 is provided over the top of hollow bowl 16 forming the firebox.

In addition, a swingout horizontal grill 50 is useful for the preparation of food.

The pedestal 14 can be provided with a compartment or drawer 52 which collects the ashes falling from the firebox. The drawer 52 can be removed to dispose of ashes.

The bowl 16 can be formed of sheet metal or stainless steel and these materials are particularly adapted to the constructions shown in detail in FIG. 7. Bowl 16 can also be a cast metal which is preferred for the alternate embodiment of FIG. 8.

The holding of the lower edge of slidable panel 26 by hooks 46 and upstanding member 42 (FIG. 7), or by groove 47 (FIG. 8) provides the advantages discussed hereinabove.

For the sake of simplicity and to give the claims of this patent application the broadest interpretation and construction possible, the following definitions will apply:

The word "apical" or derivative thereof essentially means located in the area of an apex (the highest point, place or region), such as (for example) the point of a triangle having an essentially horizontal base side.

The word "bowl" or derivative thereof essentially means any open-top housing, including (but not limited to) a traditional bowl-shaped configuration having an annular upper lip and arcuate sides converging and sloping inwardly.

The word "doming" or derivative thereof essentially means to constitute or contribute to a hemispherical vaulted configuration commonly known as a dome, such as (for example) contiguous panel members (stationary and/or movable) each having an arcuate horizontal base edge and lateral edges essentially converging to an apex and sloping inwardly toward adjacent or opposite panel members cooperating to form a dome.

The word "peripheral" or derivative thereof essentially means the outermost margin or region within a boundary; for example, peripheral support essentially means providing support at the boundary defining a portal or space, such as (for example) around the interior circumference of a ring.

The word "pivot" or derivative thereof essentially means to rotate or swing about a place or region, such as (for example) the rotation of a door panel having a hole impaled by a rod or bolt shaft.

Also for the sake of simplicity, the conjunctive "and" may also be taken to include the disjunctive "or," and vice versa, whenever necessary to give the claims herein the broadest interpretation and construction possible. Likewise, when the plural form is used, it may be taken to include the singular form, and vice versa.

The invention disclosed herein is not limited by construction materials to the extent that such materials satisfy the structural and/or functional requirements of any claim. For example, any material may be used so long as it satisfies the function for which it is being used, such as legs to provide height and support to a peripheral or an annular support; such materials may include (without limitation) metal, polymeric materials, wood and/or mixtures or composites thereof. As another example, an auxiliary ledge may be comprised of any materials satisfying the function of providing a horizontal surface, including (without limitation) stone (such as granite, for example), metal, polymeric materials, wood, and/or mixtures or composites thereof.

Although the invention has a number of features and variations, its most general form includes (comprises) a fire pit comprising a domed firescreen atop a firebox bowl atop a support frame. The firescreen assembly is generally fixed atop the firebox bowl (usually a horizontal peripheral lip of the bowl) using nuts and bolts, screws or other standard means of fixation. The lower portion of the bowl of the firescreen-bowl assembly is generally lowered through the inner periphery of a horizontal peripheral support into a seated position, supported by the horizontal peripheral lip of the bowl overlaying the peripheral margin of either the horizontal peripheral support or an auxiliary ledge anchored by the horizontal peripheral support.

One specific version of the invention includes a domed firescreen having an essentially triangular doming door panel that pivots at its apex while its bottom edge slides along a sliderail.

The following is a brief description of how to assemble some of the domed versions of the invention. In this version, each of four legs is attached to the ring-shaped base frame via a relatively short length of U-shaped channel attached essentially perpendicularly at the end of a strut extending off the leg toward the base frame, essentially cradling a section of base frame within the length of U-shaped channel; there may be a hole through the middle portion of the length of U-shaped channel, and a threaded aperture in the lower face of the base frame (aligned with that hole and sized to accept a bolt), so that said cradling attachment may be secured by screwing said bolt through both the hole and aligned threaded aperture until the cradling attachment is firm.

The legs are mounted at their uppermost ends to a horizontal annular support frame comprising a pair of concentric ring-supports, one having a diameter larger than the other. (Rather than being a single, one-piece annular support frame, the pair of concentric ring-supports may be comprised of corresponding subsections of both rings, joined end-to-end to complete the horizontal annular support frame.) The separation between the two horizontal concentric ring-supports should be sufficient to allow the mounting of one or more plates between them, for stabilizing the ring-supports; the separation/stabilization plates may also accommodate means for mounting the legs beneath the ring-supports, while the separation between the two horizontal ring-supports should also be sufficient to accommodate means for anchoring an auxiliary ledge atop the ring-supports.

In one version of the invention, the upper end(s) of each leg terminate(s) in a horizontal flange having hole(s) for accepting a bolt passing therethrough and through a corresponding hole through said separation/stabilization plate, with a nut securing the attachment. (In one version wherein the upper portion of each of the legs separates into a V-shaped set of sub-legs, each sub-leg terminates in a horizontal flange having a hole for accepting a bolt passing therethrough and through a corresponding hole through said plate; a single separation/stabilization plate may accommodate the attachment of the ends of both sub-legs, and/or join two adjoining subsections of ring-supports joined end-to-end to form the unified pair of concentric ring-supports.)

The auxiliary ledge may be anchored atop the ring-supports by any means sufficient to prevent the ledge (or any subsections) from separating from the horizontal annual support. In one version, downstanding threaded studs are affixed to the underside of the ledge, such as, for example, by adhesion of one end of the stud into a bore beneath the ledge; the free threaded may then be threaded through the separation between ring-supports, then threaded through a rectangular washer too large to pass through said separation, then with a nut firming up the attachment.

The firebox of the fire pit may comprise a bowl made of material that withstands fire and heat, and having an upper rim with an essentially horizontal annular periphery. The bowl should be sized to allow the lower portion to sit within the circular space bounded by the inner circumference of the annular support frame (or auxiliary ledge anchored atop the support frame), with the lip of the bowl overlapping atop said support frame and supporting the lower portion of the bowl.

Mounted atop the annular perimeter of the bowl is a domed fire screen comprising a plurality of contiguous upstanding essentially triangular-shaped arcuate open screen panels, one of which is capable of pivoting open and closed for accessing the interior of the fire pit. In one version, the domed fire screen is divided into essentially equal-sized upstanding triangular arcuate and doming screen quadrants, three of which are mounted at the lowermost margin atop the lip of the bowl. The mounting attachment may be by any means sufficient to accomplish such attachment, including (for example) a bolt having its head beneath the lip and its shaft upstanding through a hole in the lip, and extending up through a corresponding hole in the lowermost margin of the screen panel, with a nut firming up the attachment.

The door comprises (includes) a pivoting upstanding essentially triangular arcuate and doming screen door. In one version, the pivoting may be accomplished by any means sufficient to accomplish such pivoting, including (for example) an apical pivot point. In one version, a dome cap is mounted a top the domed screen, essentially straddling the contiguous apical points of the stationary screen panels; each of those apical points of the stationary screen panels m ay also be affixed to the domed cap, as further stabilization means. The dome cap includes a central hole, sized to accept a bolt. The pivot door overlays the stationary doors, with its apical point being immediately adjacent the dome cap and extending past the central hole; with a corresponding hole in the apical point of the pivot door, a bolt may be inserted through both the dome cap and the pivot door (and secured with a nut), to accomplish the pivoting relationship. In one version, the apical point of the pivot door overlays the dome cap, and the bolt is inserted downwardly through the hole in the apical point and then through the central hole in the dome cap. The head of the bolt includes an unthreaded bushing region fitting within the hole of the apical point of the pivot door, to facilitate ease of pivoting by reducing friction and/or guiding the pivoting rotation movement; the head of the bolt may also include a ring to facilitate lowering the bowl-dome assembly into its seated position within the inner circumference of the ledge or horizontal annular frame, or to otherwise prevent the escape of the pivot door impaled on the bolt. The upwardly converging marginal edge(s) of the pivot door may also include a handle to facilitate grasping the door to actuate the pivoting.

In one version, the pivot door is also slidably tethered along its lowermost edge to an arcuate rail having an arc essentially the same as that of the stationary mounted panels. The tethering may be by any means sufficient to accomplish such sliding relationship, including (for example) a bracket depending downwardly from the inner edge of the door overlaying the slide rail and adjacent edges of stationary panels, the angulation of said downstanding bracket essentially forming a crook enabling the lowermost edge of the door to ride along (and be supported on) the slide rail. The slide rail must be long enough to allow the door to fully pivot/slide enough to allow ready access to the interior of the fire pit; the slide rail is usually at least twice as long as the lowermost edge of the pivot door, and the slide rail usually is fixed at one end near the edge of a side panel adjacent the door opening.

The following is another brief description of how to assemble another of the domed versions of the invention.

Figure 11:
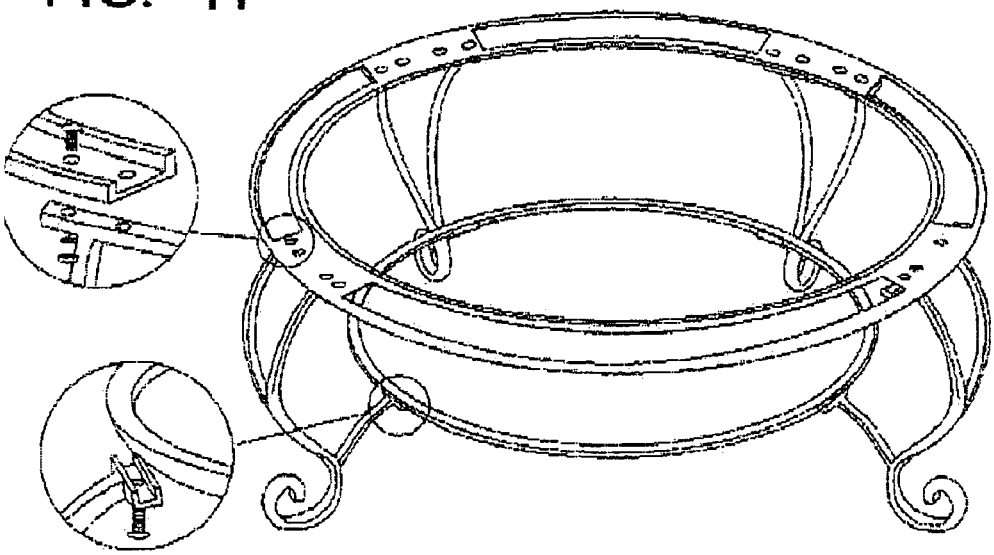
FIG. 11 is a compilation of views of portions of the invention of FIG. 9, including a perspective view of the assembled base frame, legs and horizontal annular support, together with an exploded magnified partial view of the juncture of a leg strut and the base frame, and an exploded magnified partial view of the juncture of a separation/stabilization plate and the upper end of a leg.

Take a leg (A) and attach it to a crosspiece (E) using M6×8 screws (N); affix each of them with a flat washer (O) and a nut (R). Attach the other legs and crosspieces by the same way. Attach the base frame (B) to the 4 holes on the legs using M6×10 screws (Q). (See FIG. 11.)

Put each section of granite ledge (C) on a soft surface with the polished side down, arranging all four end-to-end in a circular or annular arrangement. For each section of granite ledge, screw two of the studs (P) into their respective holes, then impale a flat rectangular washer (D) on the stud and tighten into place using round flat washer (Q) and nut (R) to affixed on the stud. Turn up the leg with the frame and adjust it to a right position until it is level with the ground, then tighten all the screws.

Figure 12:
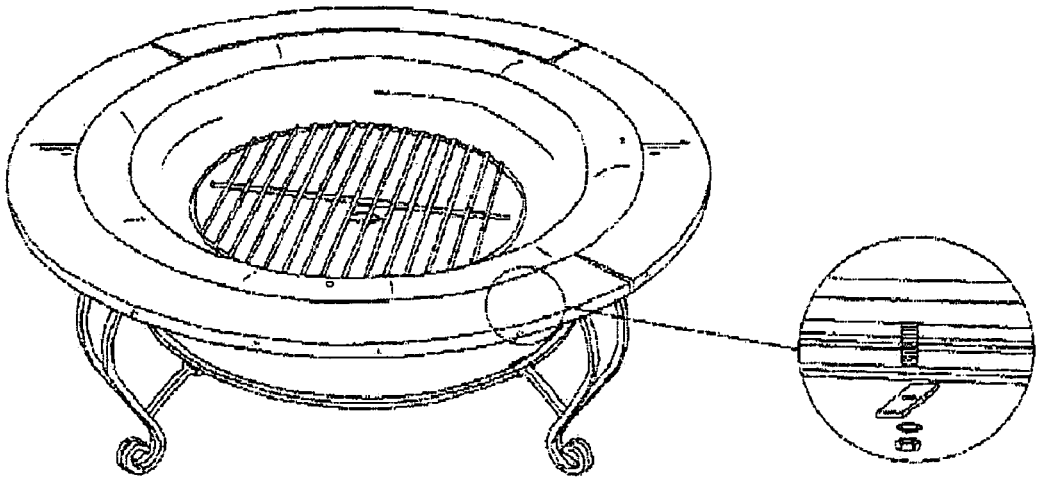
FIG. 12 is a compilation of views of portions of the invention of FIG. 9, including a perspective view of the assembly depicted in FIG. 11 with a fire pit bowl (with log grate) sitting within the interior circumference of the auxiliary ledge a fixed a top the horizontal annular support, together with an exploded magnified partial view depicting a cross section of a fixation point.
Figure 13:
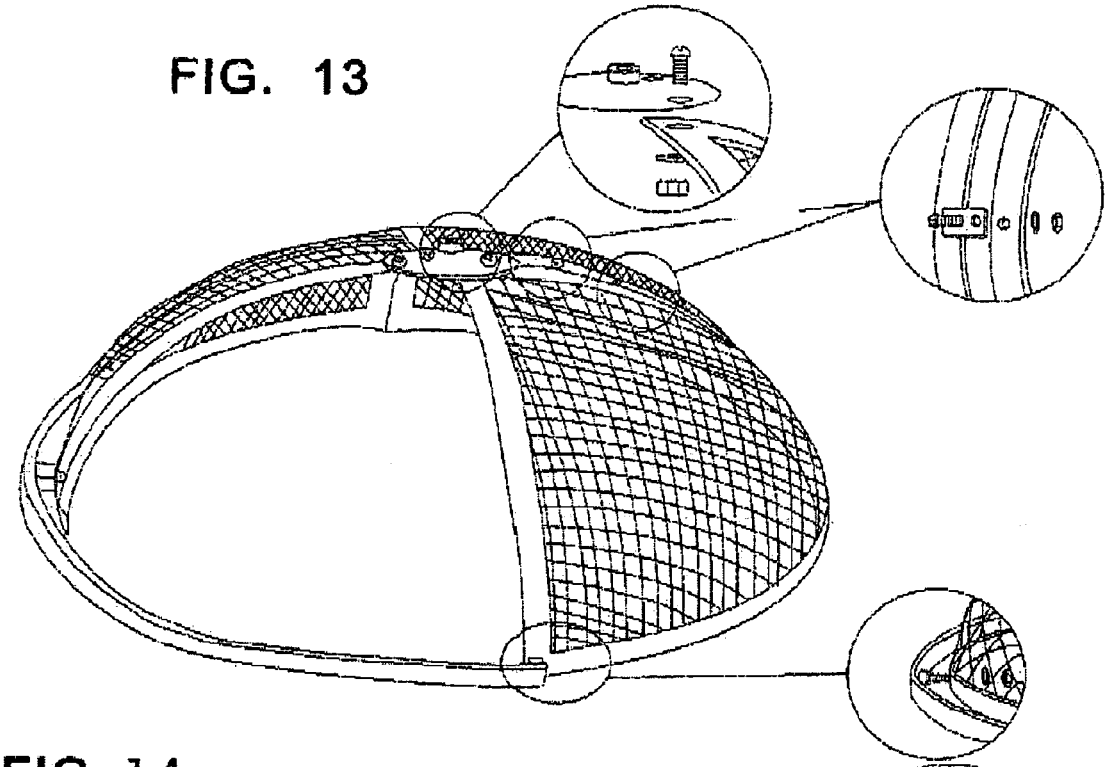
FIG. 13 depicts a perspective view of the domed fire screen assembly of invention of FIG. 9, without its door or apical pivot members.

Put the copper bowl (F) on the base and put log grill (G) in the bowl (F). (see FIG. 12.)

Attach the 5-hole panel (D) to the side panel using a screw (N), flat washer (O) and nut (R). Repeat the same step for another side of the panel. Then place them on the base. (See FIG. 12.) Place the slide rail (H) on the bowl (F) by inserting the installed screw into the hole on the side panel.

Put the dome on the copper bowl (F) and fix the dome on the slide rail (H) by attaching flat washer (O) and the nut (R). Place the top lid (L) on the top of dome and fix the top lid (L) with side panel (J) and middle panel (K) using screw an M6×8 (N), a flat washer M6(O) and a nut (R).

Screw the hanger (M) onto the installed screw on the top lid (L). Put the bottom of side panel on the slide rail (H), and put the screw of top lid (L) through the upper hole of side panel, then screw the hanger (M) onto the screw of top lid.

Figure 14:
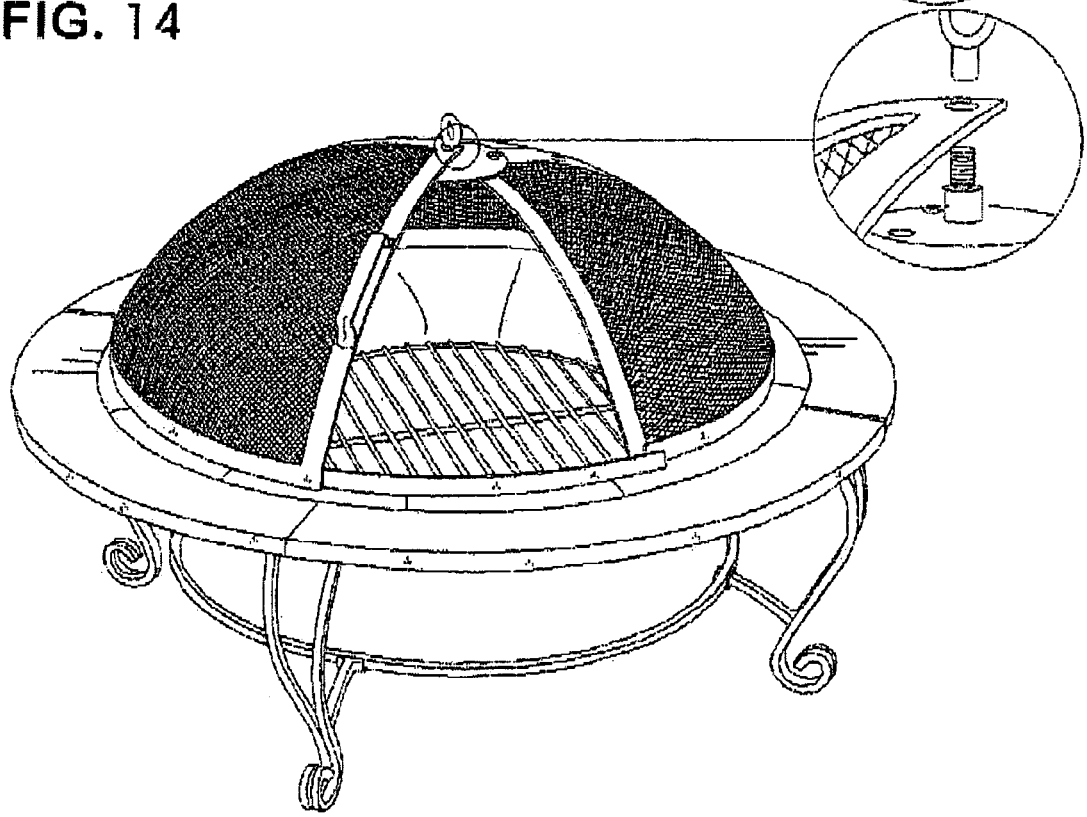
FIG. 14 is a compilation of views of portions of the invention of FIG. 9, including the assembled invention depicted in FIG. 9 together with an exploded magnified partial view of the apical pivot members.
Figure 15:
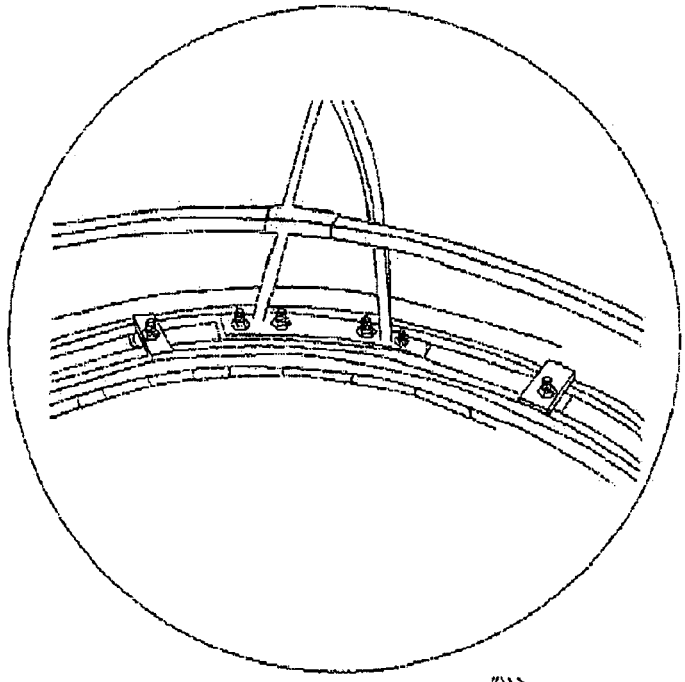
FIG. 15 is an exploded magnified partial view from the underside, depicting one version of the horizontal annular support anchoring of the auxiliary ledge, the horizontal annular support mounting with the legs, and the attachment of the leg struts to the base frame.
Figure 16:
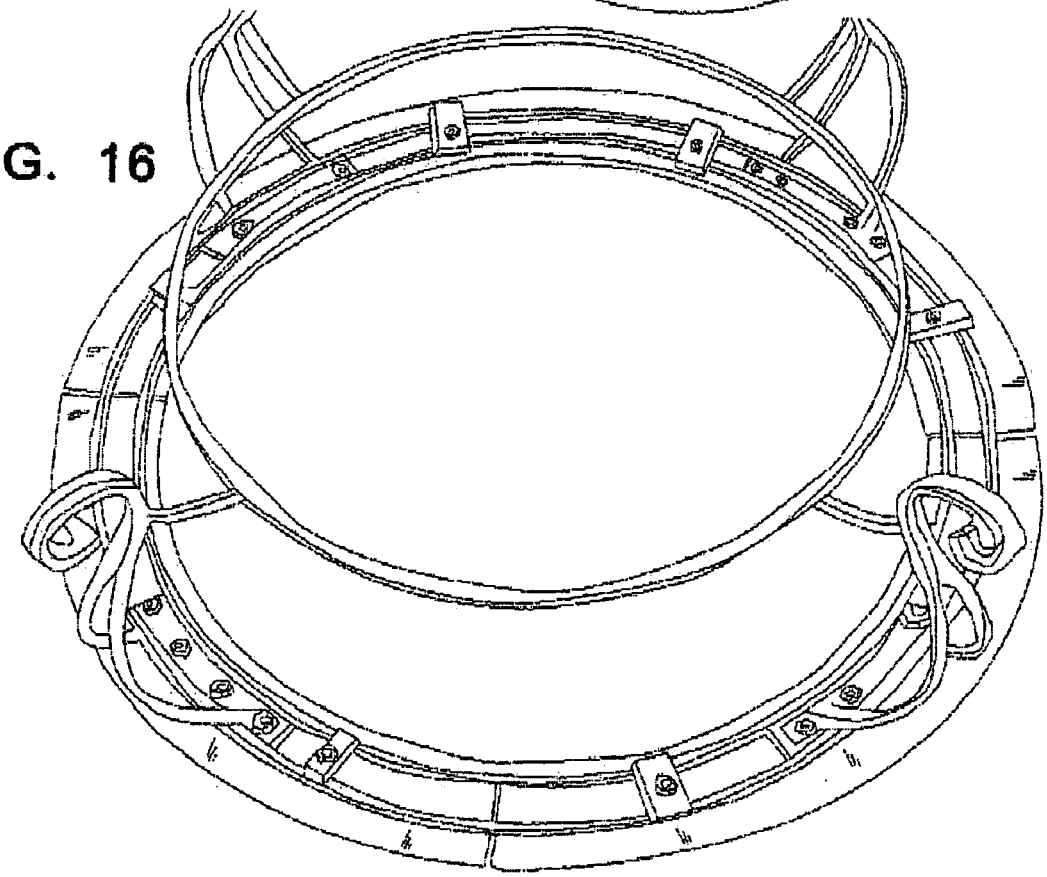
FIG. 16 is a perspective view of the version of the invention shown in FIG. 15, depicting the underside of the horizontal annular support anchoring of the auxiliary ledge, the horizontal annular support mounting with the legs, and the attachment of the leg struts to the base frame.
Figure 17:
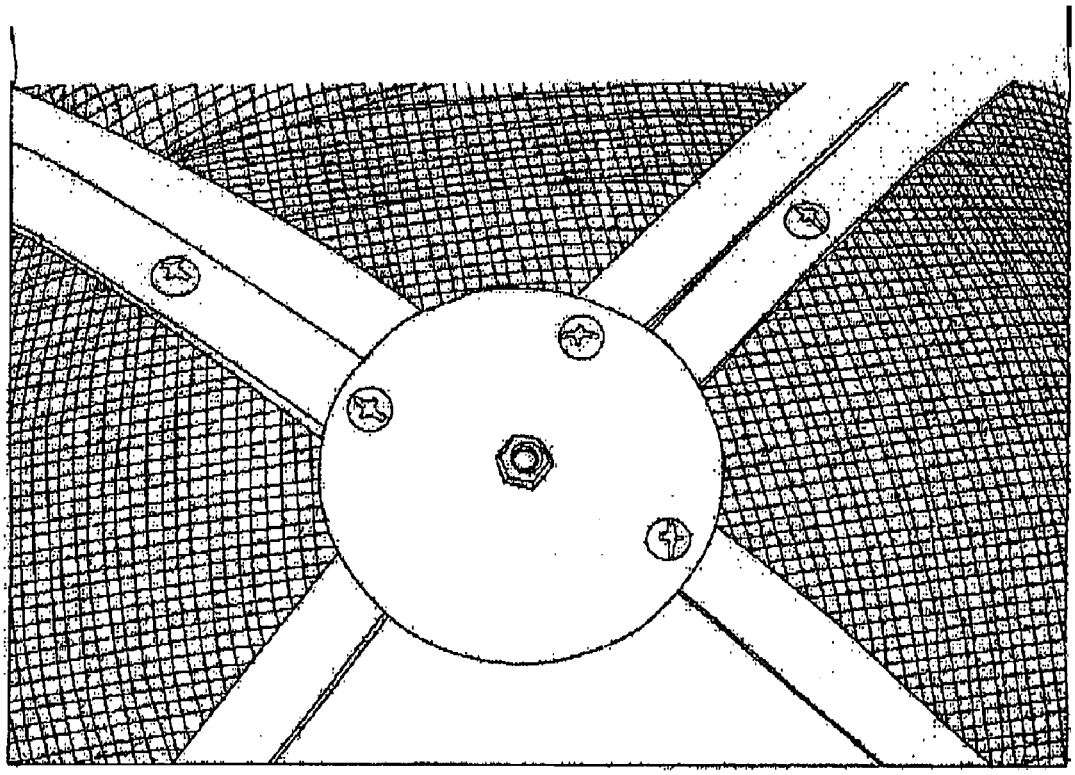
FIG. 17 depicts a top plan view of one version of an arcuate slide rail.
Figure 18:
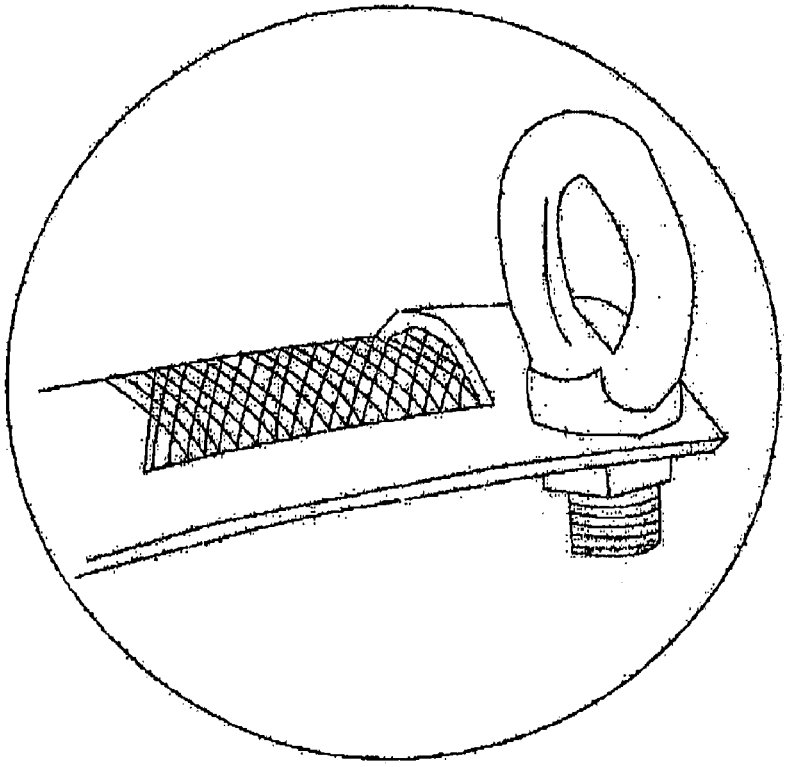
FIG. 18 depicts an exploded magnified partial view of the attachment of one end of the slide rail of FIG. 17.
Figure 19:
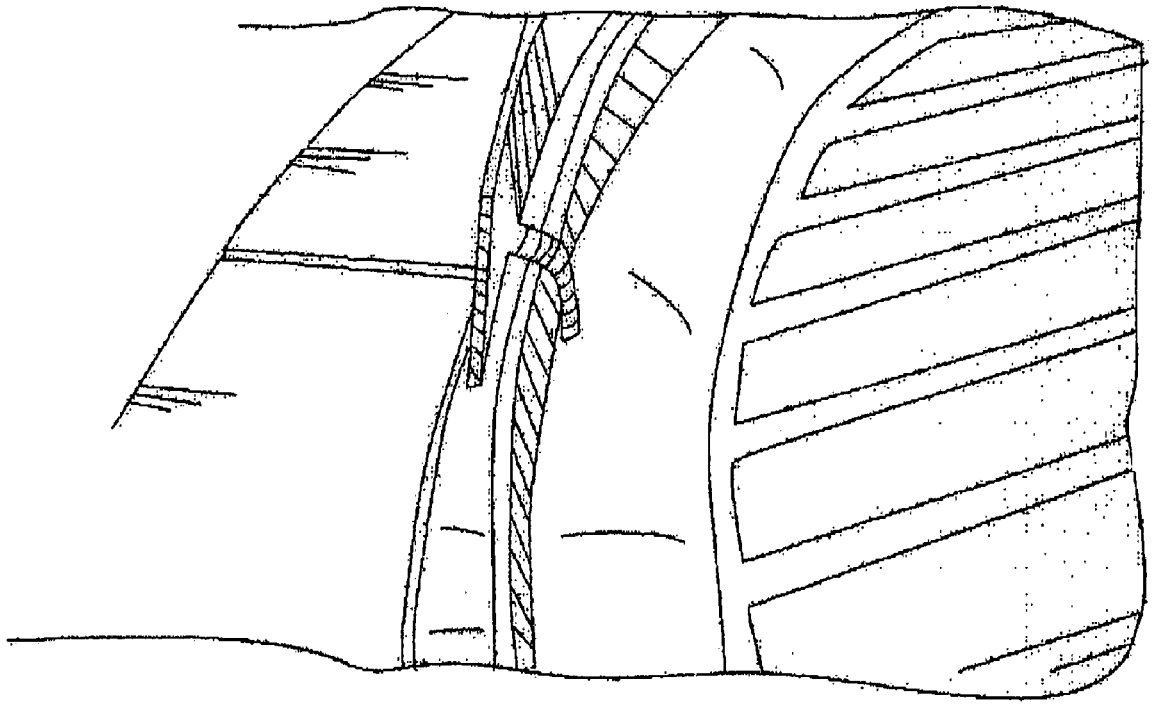
FIG. 19 is an exploded magnified partial view of one version of a bracket guiding the lower edge of a door along a slide rail.
Figure 20:
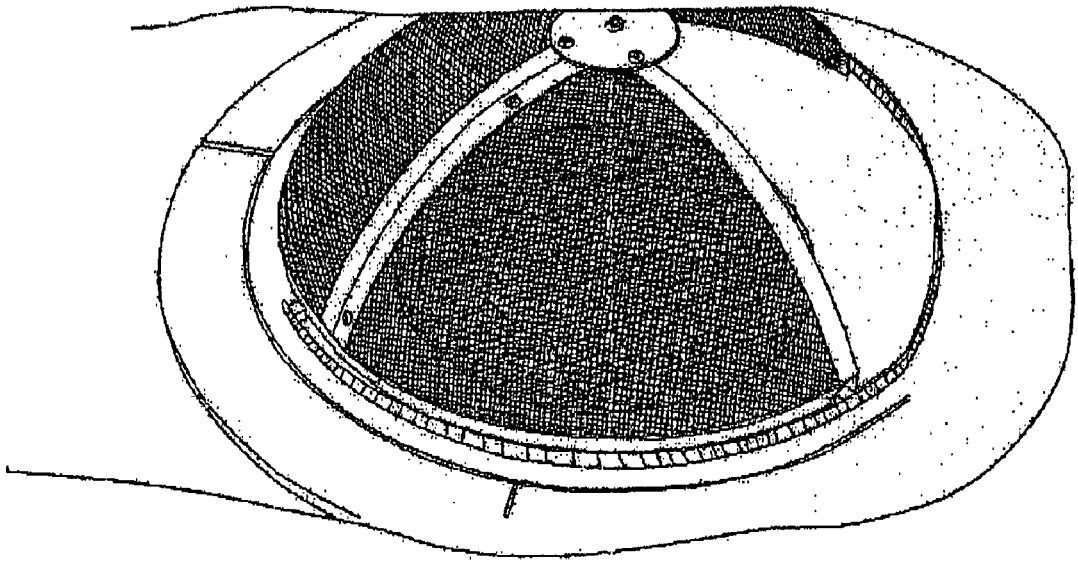
FIG. 20 depicts a top plan view of one version of a domed cap connected to the apexes of three adjacent stationary screen panels, and having a center hole.
Figure 21:
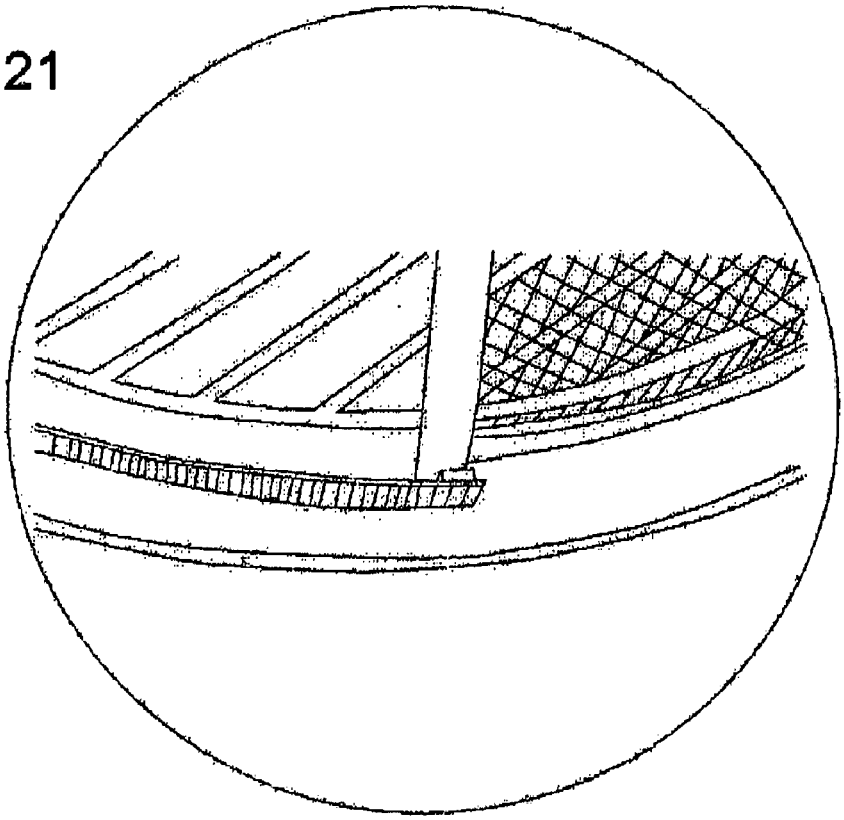
FIG. 21 is an exploded magnified partial view depicting one version of the apical point of a pivot door, having a hole impaled by a ring-headed bolt.

Tighten all the screws on the dome, and then fix the dome and copper bowl (F) with a flat washer M6(O) and nut (R). (See FIG. 14.)

Aside from the device disclosed herein, the invention disclosed herein includes a method of using that device, including assembling the fire pit (as described herein), then opening the pivot door and depositing flammable materials within the firebox bowl (with or without an optional fire grate), then lighting the flammable materials and closing the pivot door.

Those skilled in the art who have the benefit of this disclosure will appreciate that it may be used as the creative basis for designing devices or methods similar to those disclosed herein, or to design improvements to the invention disclosed herein; such new or improved creations should be recognized as dependant upon the invention disclosed herein, to the extent of such reliance upon this disclosure.

I claim:

1. A fire pit, comprising:

a domed fire screen atop a firebox bowl atop a support frame;

said bowl comprises an essentially horizontal peripheral lip overlaying an inner periphery of a horizontal peripheral support, said lip supporting said bowl seated within said inner periphery of said horizontal peripheral support;

said lip comprises a horizontal annular periphery and said horizontal support comprises a horizontal annular support; and said horizontal annular support comprises a pair of concentric ring-supports comprising an inner ring-support within an outer ring-support, said pair of concentric ring-supports separated a distance sufficient to allow the mounting of a plurality of periodic plates between them, said plates comprising means for mounting legs beneath said ring-supports.

2. The fire pit as set forth in claim 1, wherein:

said domed fire screen comprises a plurality of contiguous doming panels.

3. The fire pit as set forth in claim 2, wherein:
said contiguous doming panels comprise a first stationary side panel and a second stationary side panel spaced therefrom, both of said stationary side panels having a lateral edge contiguous with a movable door panel spanning said space between both of said stationary side panels.

4. The fire pit as set forth in claim 3, wherein:
said movable door panel comprises a doming door panel having a bottom edge slidably carried on an arcuate sliderail.

5. The fire pit as set forth in claim 3, wherein:
said door panel is slidably carried on said arcuate sliderail by a bracket depending downwardly from an inner edge of said door panel overlaying said sliderail and said lateral edges of said stationary side panels.

6. The fire pit as set forth in claim 5, wherein:
said bracket comprises downwardly depending angulation comprising a crook enabling said bottom edge of said door panel to ride along said sliderail.

7. The fire pit as set forth in claim 6, wherein:
said sliderail comprises an arcuate length extending at least twice the length of said bottom edge of said door panel, said sliderail attached at one end near said lateral edge of said first stationary side panel contiguous with said door panel, said sliderail spanning said space between said stationary side panels and continuing until attachment of an opposite end past said lateral edge of said second stationary side panel contiguous with said door panel.

8. The fire pit as set forth in claim 3, wherein:
said door panel further comprises an apical pivot.

9. The fire pit as set forth in claim 8, wherein:
said apical pivot comprises an apical pivot point including an apical hole therein, impaled by an apical bolt.

10. The fire pit as set forth in claim 9, wherein:
said apical pivot comprises a dome cap overlaying an apical point of each of said stationary panels, said dome cap including a center hole, wherein said apical pivot point overlays said dome cap, said apical hole aligned atop said center hole, said apical bolt extending through said apical hole and center hole and secured by a nut.

11. The fire pit as set forth in claim 10, wherein:
said apical bolt comprises a bushing region immediately beneath a head of said apical bolt.

12. The fire pit as set forth in claim 11, wherein:
said apical bolt comprises a ring atop said apical bolt head.

13. The fire pit as set forth in claim 3, wherein:
said door panel further comprises a handle on an edge of said door panel.

14. The fire pit as set forth in claim 2, wherein:
at least one of said doming panels comprises open mesh screen material.

15. The fire pit as set forth in claim 1, further including an auxiliary ledge anchored atop said horizontal annular support, and with said horizontal annular lip of said bowl overlaying an inner periphery of said auxiliary ledge.

16. The fire pit as set forth in claim 1, further comprising:
a vented firescreen housing fixed atop a firebox fixed atop a base, said firescreen comprising a series of adjoining screen panels, one of said panels comprising a movable door panel slidably received between two of said fixed panels and slidably carried at its upper end by a horizontal track spanning between said two fixed panels.

17. A fire pit comprising a domed open mesh firescreen atop a firebox bowl atop a support frame: a. Said firescreen comprising three contiguous stationary doming panels comprising a first side panel, a second side panel and a middle side panel contiguous therebetween, said first side panel and second side panel spaced apart, both of said stationary side panels having a lateral edge contiguous with a movable door panel spanning said space between both of said side panels; b. said movable door panel comprising a doming door panel having a bottom edge slidably carried on an arcuate sliderail, said door panel slidably carried on said arcuate sliderail by a bracket depending downwardly from an inner edge of said door panel overlaying said sliderail and said lateral edges of said stationary side panels, said bracket comprising downwardly depending angulation comprising a crook enabling said bottom edge of said door panel to ride along said sliderail, said sliderail comprising an arcuate length extending at least twice the length of said bottom edge of said door panel, said sliderail attached at one end near said lateral edge of said first side panel contiguous with said door panel, said sliderail spanning said space between said side panels and continuing until attachment of an opposite end past said lateral edge of said second side panel contiguous with said door panel, said door panel further comprising a handle on an edge of said door panel; c. said door panel further comprising an apical pivot comprising a dome cap overlaying an apical point of each of said stationary panels, said dome cap including a center hole, wherein said apical pivot point overlays said dome cap, said apical hole aligned atop said center hole, said apical bolt extending through said apical hole and center hole and secured by a nut, said apical bolt further comprising a bushing region immediately beneath a head of said apical bolt, said apical bolt further comprising a ring atop said apical bolt head; d. said firebox bowl comprising an essentially horizontal annular peripheral lip overlaying an inner periphery of a horizontal annular support, said lip supporting said bowl seated within said inner periphery of said horizontal annular support; e. said horizontal annular support comprises a pair of concentric ring-supports comprising an inner ring-support within an outer ring-support, said pair of concentric ring-supports separated a distance sufficient to allow the mounting of a plurality of periodic plates between them, said plates comprising means for mounting legs beneath said ring-supports; and f. further comprising an auxiliary ledge anchored atop said horizontal annular support, and with said horizontal annular lip of said bowl overlaying an inner periphery of said auxiliary ledge.

* * * * *